US006946946B2

(12) United States Patent
Buswell

(10) Patent No.: US 6,946,946 B2
(45) Date of Patent: Sep. 20, 2005

(54) TOROIDAL INDUCTIVE DEVICES AND METHODS OF MAKING THE SAME

(76) Inventor: Harrie R. Buswell, 132 Lorraine Ct., Berea, KY (US) 40403

( * ) Notice: Subject to any disclaimer, the term of this patent is extended or adjusted under 35 U.S.C. 154(b) by 0 days.

(21) Appl. No.: 10/470,003

(22) PCT Filed: Jan. 23, 2002

(86) PCT No.: PCT/US02/01631

§ 371 (c)(1),
(2), (4) Date: Jul. 23, 2003

(87) PCT Pub. No.: WO02/059914

PCT Pub. Date: Aug. 1, 2002

(65) Prior Publication Data

US 2004/0066267 A1 Apr. 8, 2004

Related U.S. Application Data

(60) Provisional application No. 60/263,638, filed on Jan. 23, 2001.

(51) Int. Cl.[7] ..... H01F 27/28

(52) U.S. Cl. ..... 336/229; 336/175; 363/24; 363/134; 323/339

(58) Field of Search ..... 336/83, 84 M, 336/92, 175, 177, 178, 229; 363/24, 25, 26, 134; 323/328, 338, 339, 345, 361

(56) References Cited

U.S. PATENT DOCUMENTS

| | | | | | |
|---|---|---|---|---|---|
| 3,659,336 | A | | 5/1972 | Horne | 29/605 |
| 4,551,700 | A | | 11/1985 | Waldemar | 336/192 |
| 4,652,771 | A | | 3/1987 | Specht | 307/83 |
| 4,833,436 | A | | 5/1989 | Martin et al. | 336/60 |
| 4,845,606 | A | * | 7/1989 | Herbert | 363/24 |
| 5,400,005 | A | | 3/1995 | Bobry | 336/83 |
| 5,402,097 | A | | 3/1995 | Chou | 336/192 |
| 5,828,282 | A | * | 10/1998 | Tiemann | 336/84 R |
| 5,838,220 | A | | 11/1998 | Hagberg | 336/206 |
| 6,229,305 | B1 | | 5/2001 | Logue | 324/240 |
| 6,243,940 | B1 | | 6/2001 | Rund et al. | 29/608 |
| 6,512,438 | B1 | * | 1/2003 | Yoshimori et al. | 336/178 |
| 6,583,698 | B2 | * | 6/2003 | Buswell | 336/83 |

FOREIGN PATENT DOCUMENTS

| | | |
|---|---|---|
| CN | 1155155 | 7/1997 |
| JP | 2224309 | 9/1990 |
| WO | WO 00/44006 | 7/2000 |

* cited by examiner

*Primary Examiner*—Anh Mai
*Assistant Examiner*—Jennifer A. Poker
(74) *Attorney, Agent, or Firm*—Miles & Stockbridge, P.C.

(57) ABSTRACT

An inductive device comprises an electric winding component having a generally toroidal shape, and a plurality of discrete magnetic components at least partially embracing the electric winding component so as to complete a magnetic flux path and to form at least one gap between end portions of the plurality of discrete magnetic components.

39 Claims, 4 Drawing Sheets

TOROIDAL INDUCTIVE DEVICES AND METHODS OF MAKING THE SAME

CROSS REFERENCE TO RELATED APPLICATIONS

This application claims the benefit of provisional Application No. 60/263,638, filed on Jan. 23, 2001, which is incorporated herein by reference.

BACKGROUND OF THE INVENTION

1. Field of the Invention

The present invention relates to the field of toroidal inductive devices, and more particularly to toroidal inductive devices such as transformers, chokes, coils, ballasts, and the like.

2. Description of Related Art

Conventionally available toroidal inductive devices include a toroidal shaped magnetic core made of strips of grain oriented steel, continuous strips of alloys, or various powdered core arrangements, surrounded by a layer of electrical insulation. An electrical winding is wrapped around the core and distributed along the circumference of the core. This may be done in a toroidal winding machine, for example. Depending upon the type of toroidal inductive device, an additional layer of electrical insulation is wrapped around the electrical winding and a second electrical winding is wound on top of the additional insulation. An outer layer of insulation is typically added on top of the second winding to protect the second winding unless the toroidal device is potted in plastic or the like. A representative toroidal inductive device is described in U.S. Pat. No. 5,838,220.

Toroidal inductive devices provide several key advantages over the more common E-I type inductive devices. For instance, the magnetic core shape minimizes the amount of material required, thereby reducing the overall size and weight of the device. Since the windings are symmetrically spread over the entire magnetic core of the device, the wire lengths are relatively short, thus further contributing to the reduced size and weight of the device. Additional advantages include less flux leakage, less noise and heat, and in some applications higher reliability.

One significant shortcoming of conventional toroidal inductive devices is that the manufacturing costs far exceed those associated with the more common E-I type inductive devices. The costs are high because complex winding techniques are necessary to wind the electric windings around the toroidal shaped magnetic core.

An additional shortcoming of conventional toroidal inductive devices is that they have a vulnerability to high in-rush current. Conventionally available toroidal inductive devices generally cannot provide controllable magnetic reluctance, because they are generally manufactured such that they have no control over gap in a flux path. The gap provided is generally whatever space exists between the steel strips of the magnetic core. A resistor is often added in series with the primary winding of toroidal inductive devices to protect against in-rush currents. Some methods of creating gaps of desired sizes have been developed, such as the techniques disclosed in U.S. Pat. No. 6,243,940. However, those techniques, as well as others, only add to the costs of making the inductive device. Accordingly, conventional toroidal inductive devices and methods do not provide a cost effective way to create a desired gap size in order to accommodate in-rush currents.

SUMMARY OF THE INVENTION

The present invention provides a toroidal inductive device and methods of making the same that overcome the deficiencies of the prior art. As will be seen hereinafter, the invention takes a fundamentally different design approach than that reflected in conventionally available toriodal inductive devices and, as a result, provides a cost effective way to control in-rush currents. More specifically, the invention is based on a design in which the electrical windings is itself configured in a generally toroidal shape and is embraced by a plurality of discrete magnetic components that complete a flux path. End portions of the plurality of magnetic components form a gap, which provides a magnetic reluctance in the flux path of the magnetic components. The size of the gap is controllable by determining the lengths and positions of the magnetic components. Thus, since the discrete magnetic components embrace the electric winding, the gap can be efficiently and cost effectively controlled to arrive at a size that introduces a desired amount of magnetic reluctance.

In accordance with one of its principal aspects, the present invention provides an inductive device having an electric winding component with a generally toroidal shape, and a plurality of discrete magnetic components at least partially embracing the electric winding component so as to complete a magnetic flux path passing through at least a portion of the electric winding component and to form at least one gap between end portions of the plurality of discrete magnetic components.

In accordance with another one of its principal aspects, the present invention also provides a method for making an inductive device that includes providing an electric winding component having a generally toroidal shape, and arranging a plurality of discrete magnetic components to at least partially embrace the electric winding component so as to complete a magnetic flux path passing through at least a portion of the electric winding component and to form at least one gap between end portions of the plurality of discrete magnetic components.

According to a preferred embodiment, the present invention provides a toroidal inductive device having a plurality of magnetic components and an electric winding component, wherein the plurality of magnetic components include a plurality of wires extending substantially around the electric winding component. The plurality of wires are positioned on the electric winding component either individually or in groups, which are held together by a magnetic sealant or other suitable means. The electric winding component includes at least one electric winding, which may be formed by winding a single wire generally in the shape of a toroid. In various embodiments, the plurality of wires include wires of different diameters and/or different cross-sectional shapes. Further, in other embodiments, the electric winding includes several wires of varying sizes and shapes.

In a preferred form the gap is evenly distributed around an interior of the toroid, such that magnetic flux leakage is contained and limited within the inductive device.

The end portions of the plurality of magnetic components may substantially meet at or near an exterior mid-section and/or an interior mid-section of the toroid. The end portions may have spaced end faces, may be positioned in an end-to-end abutting arrangement, or may be positioned in an overlapping arrangement. A magnetic sealant may be placed over the end portions in order to further reduce magnetic flux leakage. Advantageously, the toroidal inductive device of this invention provides an improved, i.e., higher, frequency range of operation.

In a preferred embodiment of the present invention, plates or end caps are used to enclose an interior area of the toroidal inductive device. A magnetic sealant is disposed in the entire interior area to prevent magnetic flux leakage. In other embodiments, the end caps are used to support a mounting post, which extend portions through the end caps. The mounting post may extend from one or both sides of the device, as desired. Alternative mounting means may similarly be employed, including a mounting washer and rubber pad, or an L-shaped or omega-shaped bracket.

In accordance with another preferred embodiment of the present invention, the plurality of magnetic components may include wires of different diameters, shapes and/or materials selected to optimize various characteristics of the magnetic circuit. For example, a portion of the magnetic components may include a wire fabricated of a material which enhances permeability, enables higher saturation levels or even focuses the magnetic flux.

A preferred embodiment of a method according to this invention, includes forming the electric winding component in a generally toroidal shape, configuring a plurality of wires to substantially encircle the electric winding component to form a magnetic flux path that passes through the electric winding component, and securing the end portions of the plurality of wires in close proximity to each other to form a gap.

According to another aspect of the invention, the plurality of discrete magnetic components may be arranged such that the gap in the magnetic flux path is eliminated, as by welding the ends of the magnetic components together. Such a construction may be desirable for certain applications, such as large power transformers.

BRIEF DESCRIPTION OF THE DRAWINGS

The foregoing and other aspects, features and advantages of the present invention will become apparent from the following description of the preferred embodiments, with reference to the accompanying drawings, wherein.

DETAILED DESCRIPTION OF TIE PREFERRED EMBODIMENTS

Figure 1:
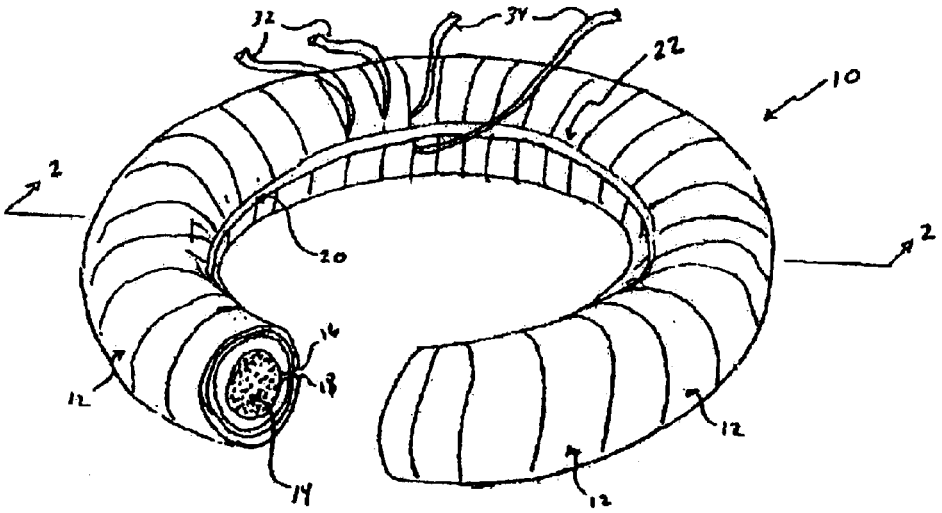
FIG. 1 is a cut-away perspective view of an inductive device according to a preferred embodiment of the present invention.
Figure 2:
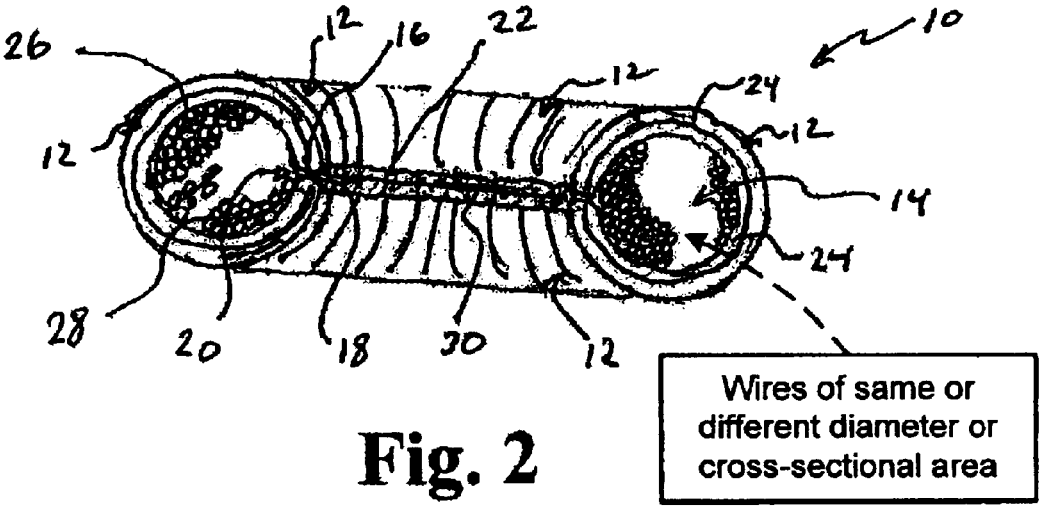
FIG. 2 is a cross-sectional view of the inductive device taken along the line 2—2 in FIG. 1.

FIG. 1 is a cut-away perspective view of a toroidal inductive device 10 according to a preferred embodiment. FIG. 2 is a cross-sectional view of the inductive device 10 taken along the line 2—2 in FIG. 1. The inductive device 10 is a transformer in this embodiment. It should be appreciated, however, that the principles of this invention are applicable to a variety of inductive devices, such as, but not limited to: transformers and coils (chokes, reactors, etc.) both of types that utilize core saturation (saturable transformers, magnetic amplifiers, saturable reactors, swinging chokes, etc.) and those that do not, as well as AC applications of solenoids, relays, contactors, and linear and rotary inductive devices.

The toroidal inductive device 10 includes a plurality of magnetic components 12 and an electric winding component 14. In conventional toroidal inductive devices electrical windings extend around a toroidal shaped magnetic component. By contrast, in the present invention, the plurality of magnetic components 12 partially embrace or extend around the electric winding component 14, which has a generally toroidal shape, as shown in FIG. 1.

The plurality of magnetic components 12 have first and second end portions 16 and 18, respectively. In this embodiment, the plurality of magnetic components 12 substantially encircle the electric winding component 14 so as to complete a magnetic flux path that extends through at least a portion of the electric winding component 14. However, it should be appreciated that in other embodiments, the plurality of magnetic components may embrace a relatively smaller portion of the electric winding component or they completely encircle the electric winding component. In other words, the plurality of magnetic components may be of any length so long as a magnetic flux path is created that passes through at least a portion of the electric winding component. Preferably, however, the flux path passes through the entire electric winding component since this will provide a higher efficiency device.

In the embodiment shown in FIGS. 1 and 2, a gap 20 is formed between the end portions 16 and 18 of the plurality of magnetic components 12. The gap 20 introduces a magnetic reluctance to the flux path. The reluctance acts to reduce the negative effects of in-rush currents.

The width of the gap 20 is determined by a distance between the first and second end portions 16 and 18 of the plurality of magnetic components 12. The gap 20 is distributed evenly around an inner circumference the toroidal inductive device 10. The end portions 16 and 18 are opposed to each other along an interior mid-section 22 of the toroidal inductive device 10. The size of the gap is controlled by setting the distance between the first and second end portions 16 and 18.

With the gap disposed at an interior mid-section 22 of the inductive device 10, the flux leakage from the gap will be substantially localized within the inductive device 10 so as not to interfere with surrounding components. In many applications, it is desirable to minimize (but not eliminate) the gap. Conventional toroidal inductive devices generally cannot provide this desired condition without increasing manufacturing costs considerably. However, the present invention can cost effectively provide this condition because the first and second end portions 16 and 18, being on the exterior of the electric winding component, can easily be arranged to set a minimal gap. Magnetic flux leakage out of the gap 20 is further contained with a magnetic sealant 30 placed in the gap to cover the end portions of the plurality of magnetic components 12. The magnetic sealant 30 may include magnetic particles made of, for example, cobalt, nickel, ferrous material alloys containing these elements in combination and in combination with lesser quantities of other elements and the like.

It should be appreciated that in other embodiments, a gap can be formed at an exterior mid-section with or without a gap at the interior mid-section of the inductive device.

Figure 7:
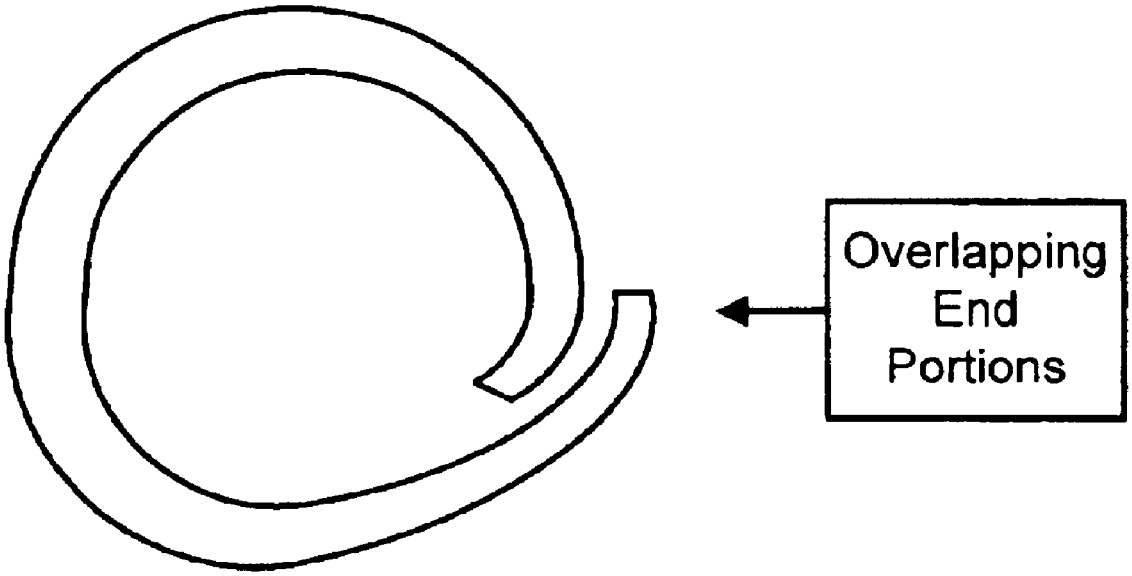
FIG. 7 is a diagrammatic view showing a magnetic component having overlapping end portions.

Further, it should be appreciated that the first and second end portions of the magnetic component may substantially meet in an overlapping arrangement, wherein the gap is formed between the overlapping end portions, as illustrated diagrammatically in FIG. 7. It should also be understood that the magnetic components can be of a variety of forms or combination of forms, including but not limited to, individual or groups of wires, ribbons, rings, bars, sheets or the like.

In the preferred embodiment shown in FIGS. 1 and 2, the plurality of magnetic components 12 are discrete components. In this embodiment, each of the plurality of magnetic components 12 includes a bundled group of wires 24. The use of wires to form the magnetic components provides an efficient way to select the lengths, in order to form a gap of a desired size, and to easily embrace the electric winding component.

The electric winding component 14 includes electric windings 26 and 28. The winding 26 is a primary winding and the winding 28 is a secondary winding. The electric windings 26 and 28 are individually formed by winding a single wire into a generally toroidal shape. Alternatively, several wires of varying sizes and shapes may be used to form the electrical windings 26 and 28. The windings 26 and 28 are positioned directly adjacent to one another. However, it will be appreciated that the relative positional arrangement of the windings 26 and 28 may be any of a variety of arrangements, including but not limited to intermingling of the respective windings. Further, an electromagnetic shield (not shown) may be provided between the respective windings to separate the windings to provide additional desired design characteristics such as capacitance control, grounding safety and the like.

The toroidal inductive device 10 includes leads 32 that connect a power source (not shown) to the primary winding 26, and leads 34 that connect the secondary winding 28 to a load (not shown). Those skilled in the art will realize that designation of primary and secondary windings is somewhat arbitrary, and that one may reverse the leads 12 and 14. The designations of "primary" and "secondary" are therefore used herein as a convenience, and it should understood that the windings are reversible.

In accordance with another aspect of this invention, the discrete magnetic components may provide a complete magnetic circuit with no gaps. For example, in such embodiments, the end portions 16 and 18 may meet and be fixed together, such as by welding or the like, so that there is no gap in the flux path. Applications where such a condition is desirable include, but are not limited to, large current coils and transformers involved in electric power generation and transmission for attaining increased efficiency of operation.

In still other embodiments, at least one of the discrete magnetic components forms a gap and at least one does not. With this combination of gap and non-gap arrangement, a desirable set of conditions can be attained. Particularly, the efficiency of the device is increased even while maintaining a precise gap control to accommodate for the in-rush problem.

Figure 3:
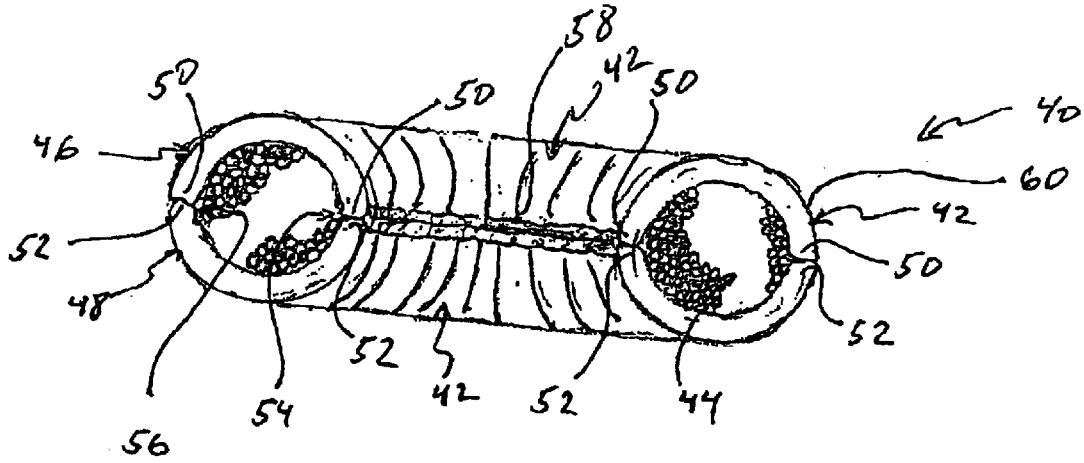
FIG. 3 is a cross-sectional view of an inductive device according to an alternative embodiment of the present invention.

FIG. 3 is a cross-sectional view of a toroidal inductive device 40 according to an alternative embodiment of the invention. The toroidal inductive device 40 is similar to the previous embodiment in that it includes a plurality of discrete magnetic components 42 and a toroidal shaped electric winding component 44. The plurality of magnetic components 42 substantially encircle the electric winding component 44 so at to complete a flux path that passes through at least a portion of the electric winding component 44. However, in this embodiment, at least one of the plurality of magnetic components 42 includes a first magnetic member 46 and a second portion 48. The first and second magnetic members 46 and 48 each have end portions 50 and 52, respectively. The end portions 50 and 52 substantially meet to form gaps 54 and 56. The gaps 54 and 56 are similar to the gap 20 referenced above, and introduce reluctance in the flux path. The gap 54 is positioned on an inner-surface 58 of the inductive device 40 and the gap 56 is positioned on an outer-surface 60 of the inductive device 40. Magnetic sealants 62 and 64 are disposed in the gaps 54 and 56, respectively, to reduce the amount of flux leakage out of the gaps 54 and 56. Similar to the magnetic sealant 30, magnetic sealants 62 and 64 may include magnetic particles such as, but not limited to, cobalt, nickel, ferrous materials, alloys containing these elements in combination and in combination with lesser quantities of other elements, and the like.

Figure 4:
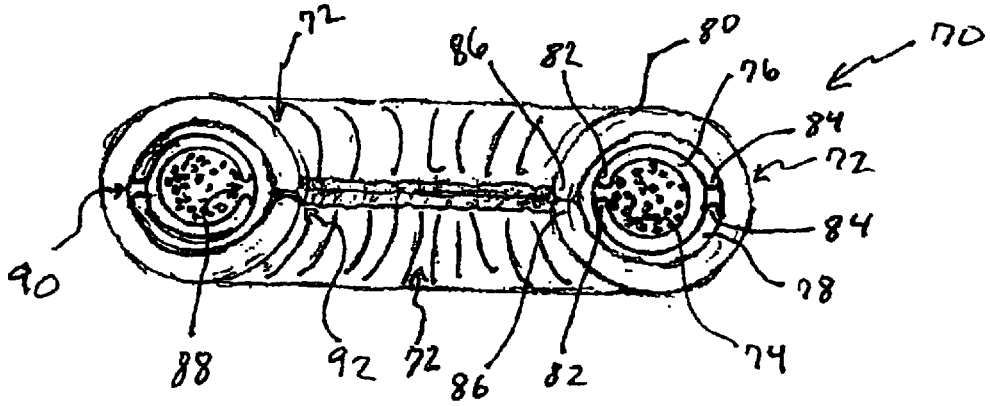
FIG. 4 is a cross-sectional view of an inductive according to another embodiment of the invention.

FIG. 4 is a cross-sectional view of a toroidal inductive device 70 according to another embodiment of this invention. The toroidal inductive device 70 is similar to the previous embodiments in that it includes a plurality of discrete magnetic components 72 and a toroidal shaped electric winding component 74. The plurality of magnetic components 72 substantially encircle the electric winding component 74 so as to complete a magnetic flux path that passes through at least a portion of the electric winding component 74. However, in this embodiment, at least one of the plurality of magnetic components 72 includes a first magnetic member 76, a second magnetic member 78 and a third magnetic member 80. The first, second and third magnetic members 76, 78 and 80 each have end portions 82, 84 and 86, respectively.

The first magnetic member 76 substantially encircles the electric winding component 74 so that the end portions 82 substantially meet forming a gap 88.

The second magnetic member 78 substantially encircles the first magnetic member 76 so that the end portions 84 substantially meet forming a gap 90. The second magnetic member 78 is positioned relative to the first magnetic member 76 such that the gaps 88 and 90 are disposed on opposite sides of the at least one magnetic component.

The third magnetic member 80 substantially encircles the second magnetic member 78 so that the end portions 86 substantially meet forming a gap 92. The third magnetic member 80 is positioned relative to the second magnetic member 78 such that the gaps 90 and 92 are disposed on opposite sides of the at least one magnetic component.

The gaps 88, 90 and 92 are similar to the gap 20 referenced above, in that they may introduce reluctance in the flux path. With the relative arrangements of the first, second and the third magnetic members 76, 78 and 80, such that the gap 88 is substantially covered by the second magnetic member 78 and the gap 90 is substantially covered by the third magnetic member 80, the flux leakage out of the gaps 88 and 90 is substantially contained within the magnetic components 72. Magnetic sealants are not used in the gaps of this embodiment but may be included if desired.

Figure 5:
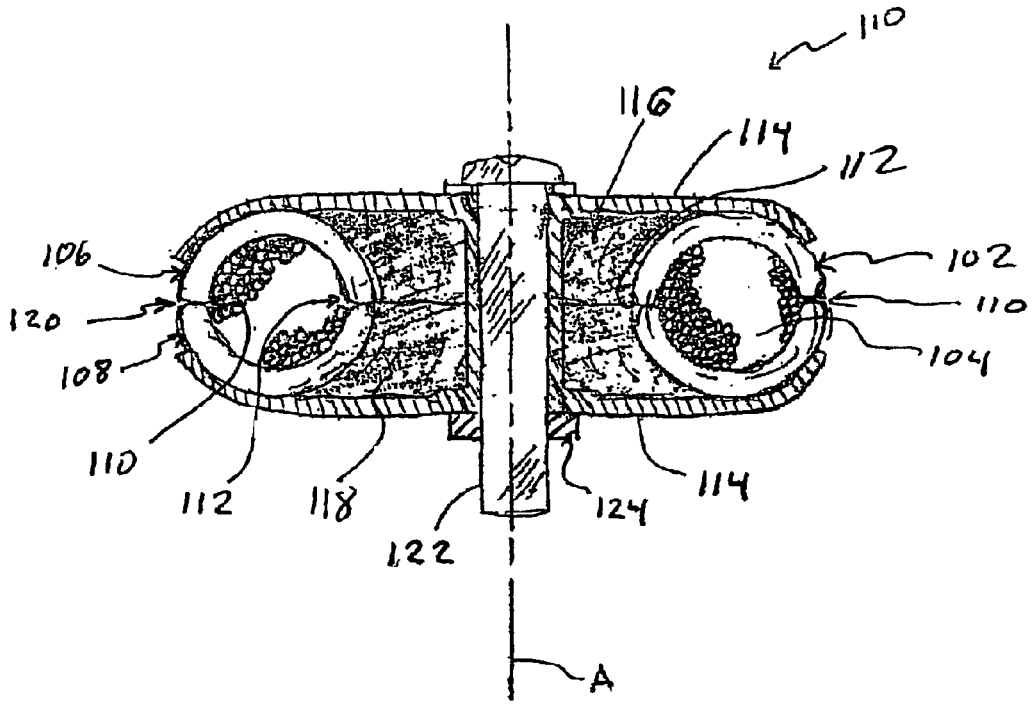
FIG. 5 is a cross-sectional view showing an inductive device including a pair of end caps and a mounting post.

FIG. 5 is a cross-sectional view of a toroidal inductive device 100 according to an alternative embodiment of this invention. The toroidal inductive device 100 is similar to the inductive device 40 in that it includes a plurality of discrete magnetic components 102 and a toroidal shaped electric winding component 104. The plurality of magnetic components 102 substantially encircle the electric winding component 104 so as to complete a magnetic flux path that passes through at least a portion of the electric winding component 104. At least one of the plurality of magnetic components 102 includes a first magnetic member 106 and a second portion 108. Gaps 110 and 112 are formed between end portions of the portions 106 and 108, similar to the inductive device 40, referenced above. The gaps 110 and 112 are positioned at opposite sides of the at least one of the plurality of magnetic components 102.

The inductive device 100 further includes plates or end caps 114 disposed on opposite sides of the plurality of magnetic components 102. An interior space 116 is defined between the end caps and the plurality of magnetic components 102. A magnetic sealant 118 is disposed in the interior space 116 to further contain magnetic flux leakage. The magnetic sealant 118 may include soft magnetic particles 24 selected, for example, from the group of cobalt, nickel, ferrous materials, alloys containing these elements in combination and in combination with lesser quantities of other elements, and the like.

A magnetic sealant 120, similar to the magnetic sealant 118, is disposed in the gap 110 to contain magnetic flux leakage out of the gap 110.

A threaded mounting post 122 extend portions from the upper surface of the inductive device 100 to the lower surface, through both of the end caps. In this embodiment, the mounting post 122 is positioned coaxially with a center axis A of the inductive device 100. A threaded nut 124 mates with the threads of the mounting post 122 to hold the end caps 114 against the magnetic component 102. The mounting post may, of course, be arranged to extend from either side of the inductive device or both sides thereof, as desired. The mounting post may also be used as a cooling tube with a coolant flowing through the post to remove heat from the device.

Figure 6:
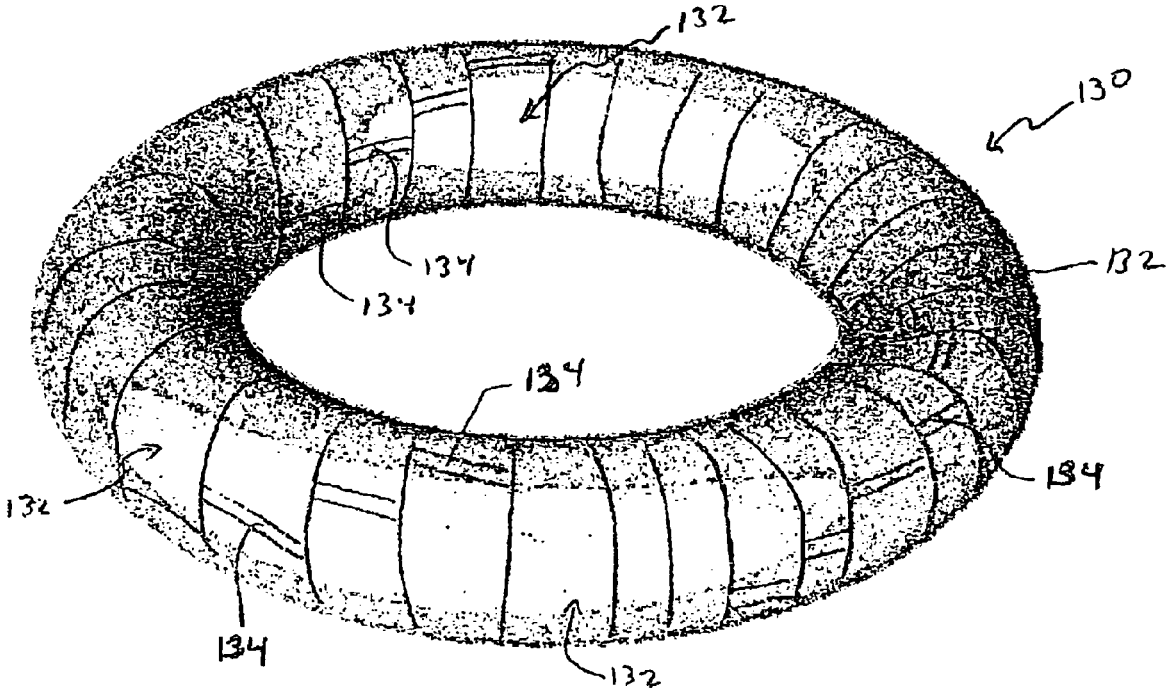
FIG. 6 is a perspective view of an inductive device according to yet another embodiment of this invention.

FIG. 6 is a perspective view of a toroidal inductive device 130 according to a further embodiment of the invention. The inductive device 130 is similar to the previous embodiments in that it includes a plurality of discrete magnetic components 132 and a generally toroidal shaped electric winding component (not shown). The magnetic components embrace the electric winding component so as to form flux paths that at least partially passes through the electric winding component. Gaps 134 are formed between end portions of the respective components.

An important aspect of this embodiment is that the gaps 134 formed by the magnetic components are distributed around the device. The gaps 134 are distributed so that eddy currents are reduced between adjacent gaps 134 or groups of gaps. Preferably, the gaps are distributed in a spiral arrangement around the device 130, as is generally shown in FIG. 6. With the gaps 134 distributed around the device, the efficiency and the upper end of the frequency range of the device will be increased.

The use of a plurality of discrete magnetic components that embrace an electric winding component yields an efficient method and cost effective way for making a toroidal inductive device, wherein an amount of reluctance in a magnetic flux path can be controlled. Specifically, placement of a plurality of magnetic components on the exterior of the electric winding component of the inductive device allows the inductive device designer to specify an amount of gap in the magnetic component as well as its distribution around the device. The reluctance of the gap is determined by the lengths of the magnetic components.

A method according to a preferred embodiment of this invention, includes providing an electric winding component by winding at least a single wire generally in the shape of a toroid to form an electric winding. The winding is initially held together by bands or the like. The electric winding component may alternatively be provided by winding multiple wires generally in the shape of a toroid. The multiple wires may include wires of the same diameter and/or shape, or a combination of different diameters and/or shapes, so as to increase the density of the winding.

The method further includes arranging a plurality of discrete magnetic components to embrace the electric windings so as to complete a magnetic flux path that passes through at least a portion of the electric winding component. A gap is formed between the end portions of the magnetic components to introduce a reluctance to the magnetic flux path. In an exemplary embodiment, the plurality of magnetic components are a plurality of wires, which are formed around the electric windings either individually or in groups. In other exemplary embodiments, the end portions of the plurality of the plurality of magnetic components substantially meet at or near an interior mid-section, and/or an exterior mid-section of the toroidal device. A magnetic sealant is applied to the end portions to secure them in place.

In an alternative embodiment of a method according to this invention, at least one of the plurality magnetic components includes a plurality of magnetic members. The method includes arranging the members such that each member substantially encircles the electric winding component and forms separate gaps between end portions of the respective member. The method also further includes arranging the members such that one of the members substantially encircles one of the other members so as to cover the gap created by the encircled member. With such an arrangement of the members, flux leakage is further contained.

In accordance with another embodiments of a method of the present invention, plate or end caps are positioned adjacent to opposite sides of the plurality of magnetic components to define an interior space between the magnetic components and the end caps. The interior space is then filled with a magnetic sealant to reduce flux leakage. A further preferred embodiment includes evacuating the interior space and injecting magnetic sealant into the space. Evacuating the interior space will allow the magnetic sealant to more fully occupy the interior space so as to substantially fill all gaps.

The foregoing description of preferred embodiments of the invention has been presented for purposes of illustration. It is not intended to be exhaustive or to limit the invention to the precise forms disclosed. Obvious modifications, variations or combinations are possible in light of the above teachings. The preferred embodiments were chosen and described to provide an illustration of the principles of the invention and its practical application to thereby enable one of ordinary skill in the art to utilize the invention in various embodiments and with various modifications and/or combinations that are suited for the particular use contemplated. Various changes may be made without departing from the spirit and scope of this invention.

What is claimed is:

1. An inductive device comprising: an electric winding component having a generally toroidal shape; and a plurality of discrete magnetic components at least partially embracing said electric winding component so as to complete a magnetic flux path and to form, in a meridional plane, at least one gap between end portions of at least one of said plurality of discrete magnetic components.

2. An inductive device as recited in claim 1, wherein said electric winding component includes at least one electric winding.

3. An inductive device as recited in claim 1, wherein said electric winding component includes wires of different cross-sectional shapes.

4. An inductive device as recited in claim 1, wherein said electric winding component includes a primary and a secondary electric winding.

5. An inductive device as recited in claim 4, wherein said primary and secondary windings are intermingled.

6. An inductive device as recited in claim 1, wherein at least one of said plurality of discrete magnetic components includes a plurality of wires.

7. An inductive device as recited in claim 6, wherein said plurality of wires include wires of different diameters arranged to increase the density of said at least one of said plurality of discrete magnetic components.

8. An inductive device as recited in claim 6, wherein said plurality of wires include wires having different cross-sectional shapes to increase the density of said at least one of said plurality of discrete magnetic components.

9. An inductive device as recited in claim 1, further comprising a magnetic sealant disposed in said at least one gap.

10. An inductive device as recited in claim 1, wherein said end portions of said plurality of discrete magnetic components overlap.

11. An inductive device as recited in claim 1, wherein at least one of said plurality of discrete magnetic components includes a first magnetic member and a second magnetic member.

12. An inductive device as recited in claim 11, wherein end portions of said first magnetic member substantially meet with end portions of said second magnetic member forming said at least one gap and a second gap.

13. An inductive device as recited in claim 12, wherein said one gap and said second gap are disposed on opposite sides of said one magnetic components.

14. An inductive device as recited in claim 1, wherein at least one of said plurality of discrete magnetic components includes a first magnetic member, a second magnetic member and a third magnetic member.

15. An inductive device as recited in claim 14, wherein: said first magnetic member at least partially embraces said electric winding component and forms said one gap between end portions of said first magnetic member; said second magnetic member at least partially embraces said first magnetic member and forms a second gap between end magnetic member of said second magnetic member; and said third magnetic member at least partially embraces said second magnetic member and forms a third gap between ends of said third magnetic member.

16. An inductive device as recited in claim 15, wherein: said one gap and said second gap are disposed at opposite sides of said one magnetic component; and said second gap and said third gap are disposed at opposite sides of said one magnetic component.

17. An inductive device as recited in claim 15, wherein said at least one gap is substantially covered by said second magnetic member and said second gap is substantially covered by said third magnetic member.

18. An inductive device as recited in claim 1, further comprising at least two plates disposed adjacent opposite surfaces of said plurality of discrete magnetic components so as to define an interior space between said plurality of discrete magnetic components and said at least two plates.

19. An inductive device as recited in claim 18, further comprising a mounting post disposed through said at least two plates.

20. An inductive device as recited in claim 18, further comprising a magnetic sealant disposed within said interior space.

21. An inductive device as recited in claim 1, wherein said plurality of discrete magnetic components substantially envelop said electric winding component to provide shielding from electromagnetic fields.

22. An inductive device as recited in claim 1, wherein said plurality of discrete magnetic components are electrically insulated from one another.

23. An inductive device as recited in claim 1, wherein each of said plurality of discrete magnetic components substantially encircles said electric winding component.

24. A method for making an inductive device, comprising: providing an electric winding component having a generally toroidal shape; and arranging a plurality of discrete magnetic components to at least partially embrace said electric winding component so as to complete a magnetic flux path and to form at least one gap, in a meridional plane, between end portions of at least one of said plurality of discrete magnetic components.

25. A method as recited in claim 24, wherein said electric winding component is at least one electric winding.

26. A method as recited in claim 24, wherein said electric winding component includes a primary and a secondary electric winding.

27. A method as recited in claim 24, further comprising intermingling said primary and secondary windings.

28. A method as recited in claim 24, wherein at least one of said plurality of discrete magnetic components includes a plurality of wires.

29. A method as recited in claim 28, wherein said plurality of wires include wires of different diameters arranged to increase the density of said at least one of said plurality of discrete magnetic components.

30. A method as recited in claim 28, wherein said plurality of wires include wires having different cross-sectional shapes to increase the density of said at least one of said plurality of discrete magnetic components.

31. A method as recited in claim 24, further comprising inserting a magnetic sealant in said at least one gap.

32. A method as recited in claim 24, wherein at least one of said plurality of discrete magnetic components includes a first magnetic member, a second magnetic member and a third magnetic member.

33. A method as recited in claim 32, wherein: said first magnetic member at least partially embraces said electric winding component and forms said one gap between end portions of said first magnetic member; said second magnetic member at least partially embraces said first magnetic member and forms a second gap between end magnetic member of said second magnetic member; and said third magnetic member at least partially embraces said second magnetic member and forms a third gap between end portions of said third magnetic member.

34. A method as recited in claim 33, wherein said at least one gap and said second gap are disposed at opposite sides of said at least one of said plurality of discrete magnetic components, and said second gap and said third gap are disposed at opposite sides of at least one of said plurality of discrete said magnetic components.

35. A method as recited in claim 24, further comprising configuring at least two plates on opposite surfaces of said plurality of discrete magnetic components defining an interior space between said plurality of discrete magnetic components and said at least two plates.

36. A method as recited in claim 35, further comprising filling said interior space with a magnetic sealant.

37. A method as recited in claim 36, further comprising creating a vacuum in said interior space prior to said filling.

38. An inductive device comprising:

an electric winding component having a generally toroidal shape; and a plurality of discrete magnetic components at least partially embracing said electric winding component so as to complete a magnetic flux path and to form a discontinuity, in a plane transverse to a winding direction of said electric winding component, between end portions of at least one of said plurality of discrete magnetic components.

39. The inductive device of claim 38, wherein the plane is a meridional plane.

* * * * *